US006173858B1

(12) United States Patent
Norwood et al.

(10) Patent No.: US 6,173,858 B1
(45) Date of Patent: Jan. 16, 2001

(54) MODIFIED TWO-PIECE THERMOFORMED CUP

(75) Inventors: David W. Norwood, Joppatowne; Larry Maccherone, Owings Mills, both of MD (US)

(73) Assignee: Sweetheart Cup Company, Owings Mills, MD (US)

( * ) Notice: Under 35 U.S.C. 154(b), the term of this patent shall be extended for 0 days.

(21) Appl. No.: 09/245,927

(22) Filed: Feb. 8, 1999

(51) Int. Cl.[7] ..... B65D 3/30

(52) U.S. Cl. ..... 220/613; 229/400; 229/406; 220/615; 220/623; 220/624; 220/626

(58) Field of Search ..... 220/613, 615, 220/623, 624, 626, 618, 620; 229/400, 406

(56) References Cited

U.S. PATENT DOCUMENTS

| | | | | |
|---|---|---|---|---|
| 167,172 | * | 9/1875 | Herget | 220/618 |
| 174,821 | * | 3/1876 | Johnson | 220/618 |
| 262,143 | * | 8/1882 | Stevenson | 220/618 |
| 844,856 | * | 2/1907 | Duffett | 220/626 |
| 919,345 | * | 4/1909 | Hackney | 220/623 |
| 3,658,615 | | 4/1972 | Amberg . | |
| 3,854,583 | | 12/1974 | Amberg et al. . | |
| 4,106,397 | | 8/1978 | Amberg et al. . | |
| 4,197,948 | | 4/1980 | Amberg et al. . | |
| 4,262,819 | * | 4/1981 | Hayes | 220/626 |
| 4,268,335 | | 5/1981 | Herbst . | |
| 4,566,604 | * | 1/1986 | Wolf et al. | 220/626 |
| 4,630,744 | | 12/1986 | Trombly . | |
| 4,715,527 | | 12/1987 | Tsuzuki et al. . | |
| 4,720,038 | * | 1/1988 | Shepard | 220/618 |
| 5,062,568 | | 11/1991 | Hill et al. . | |
| 5,507,640 | | 4/1996 | Gilmer et al. . | |

* cited by examiner

*Primary Examiner*—Joseph M. Moy
(74) *Attorney, Agent, or Firm*—Nixon & Vanderhye

(57) ABSTRACT

Two-piece cups formed, e.g., from a thermoformable plastics material, include a bottom wall disc which is bonded to an inwardly turned annular bottom flange of the side wall by an upwardly and inwardly sloped transition wall. The transition wall allows the bottom wall disc to be bonded to the sidewall flange in such a manner that the annular bottom edge is substantially unaffected by the heat and pressures during the bonding process. The bottom wall disc may be in the form of multiple concentrically disposed, annular bottom wall segments which are connected to one another by respective ones of a plurality of transition walls.

10 Claims, 3 Drawing Sheets

MODIFIED TWO-PIECE THERMOFORMED CUP

FIELD OF THE INVENTION

The present invention relates generally to two-piece thermoformed cups. In preferred forms, the present invention is embodied in two-piece thermoformed cups which have been structurally modified so as to significantly minimize bottom edge stresses and thereby improve cup strength.

BACKGROUND AND SUMMARY OF THE INVENTION

Two-piece drinking cups formed from sheets of a thermoformable plastics material (e.g., expanded polystyrene) are well known as evidenced by U.S. Pat. Nos. 3,658,615 and 3,854,583. the entire content of each being expressly incorporated hereinto by reference. In this regard, such two-piece cups are typically formed from a sidewall sheet of thermoformable plastics material whose ends are overlapped somewhat and bonded to one another to form a longitudinal sidewall seam. A bottom disc is then bonded to an inwardly turned annular bottom flange integral with the side wall to form a seal therebetween. See in this regard, U.S. Pat. No. 4,106,397, the entire content of which is expressly incorporated hereinto by reference.

One problem that is presented with conventional two-piece cups formed from thermoformable plastics materials includes the weakening of the lower annular bottom edge of the cup due to stresses that are induced by the heat and pressures involved in bonding the bottom wall disc to the inwardly turned side wall flange. Weakening of the annular bottom edge of the cup may, in turn, cause it to rupture thereby spilling the cup contents. The possibility of rupturing the bottom edge of the cup is especially acute if the cup is dropped some distance when filled with liquid. Thus, it would especially be desirable if a two-piece cup construction could be provided which minimize (if not eliminate entirely) the stresses at the bottom edge of the cup which are induced by the heat and pressures during the fabrication process. It is toward providing such a cup that the present invention is directed.

Broadly, the present invention is directed toward a two-piece cup whereby the bottom wall disc is bonded to an inwardly turned annular flange of the side wall by an upwardly and inwardly sloped transition wall. The transition wall allows the bottom wall disc to be bonded to the sidewall flange in such a manner that the annular bottom edge is substantially unaffected by the heat and pressures during the bonding process.

These and other aspects and advantages will become apparent form the following detailed description of the preferred exemplary embodiments thereof.

BRIEF DESCRIPTION OF THE ACCOMPANYING DRAWINGS

Reference will hereinafter be made to the accompanying drawings wherein like reference numerals throughout the various Figures denote like structural elements, and wherein.

DETAILED DESCRIPTION OF THE INVENTION

Figure 1:
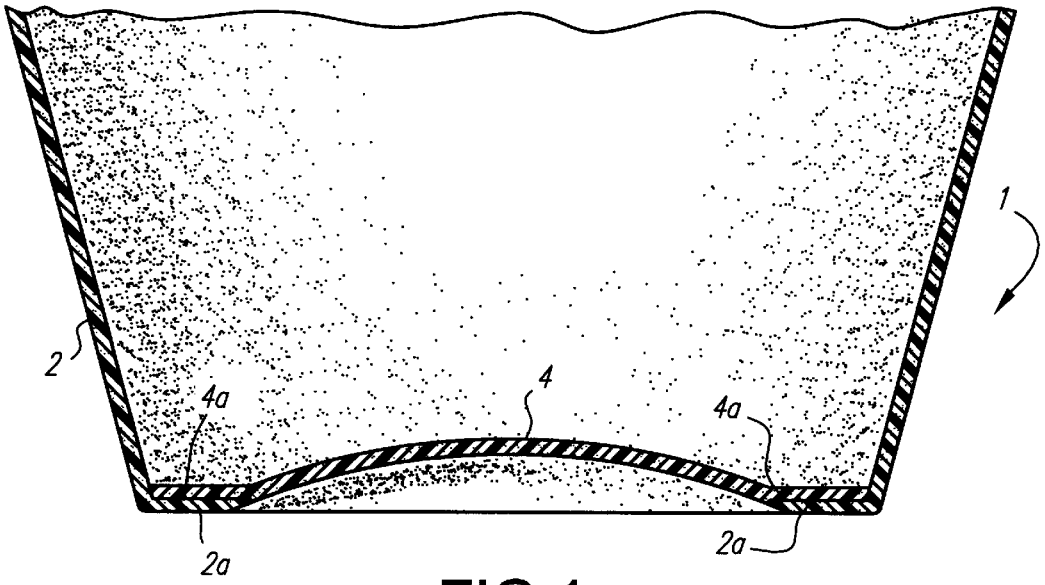
FIG.1 (PRIOR ART)
FIG. 1 is a cross-sectional elevational view of a prior art bottom wall cup design.

Accompanying FIG. 1 depicts a thermoformed cup 1 having a conventional bottom wall construction generally in accordance with the teaching of the above-cited U.S. Pat. Nos. 3,854,583 and 4,197,948). In this regard, the cup 1 includes a side wall 2 formed, for example, from a sheet of a thermoformable plastics material. The side wall 2 terminates in an annular bottom flange 2*a*. A bottom wall disc 3 having an arcuate concavity is positioned within the cup so that its outer peripheral region 3*a* is superposed on the inwardly turned flange 2*a* of the side wall 2. The application of heat and pressure (e.g., in accordance with the above-cited U.S. Pat. No. 4,197,948) will cause the flange 2*a* of the side wall 2 and the peripheral region 3*a* of the bottom wall disc 3 to be bonded to one another in a leak-proof manner. However, such pressure will also create stresses at the annular bottom edge 4 which might lead to premature fracture of the cup thereat causing leakage of the cup contents.

Figure 3:
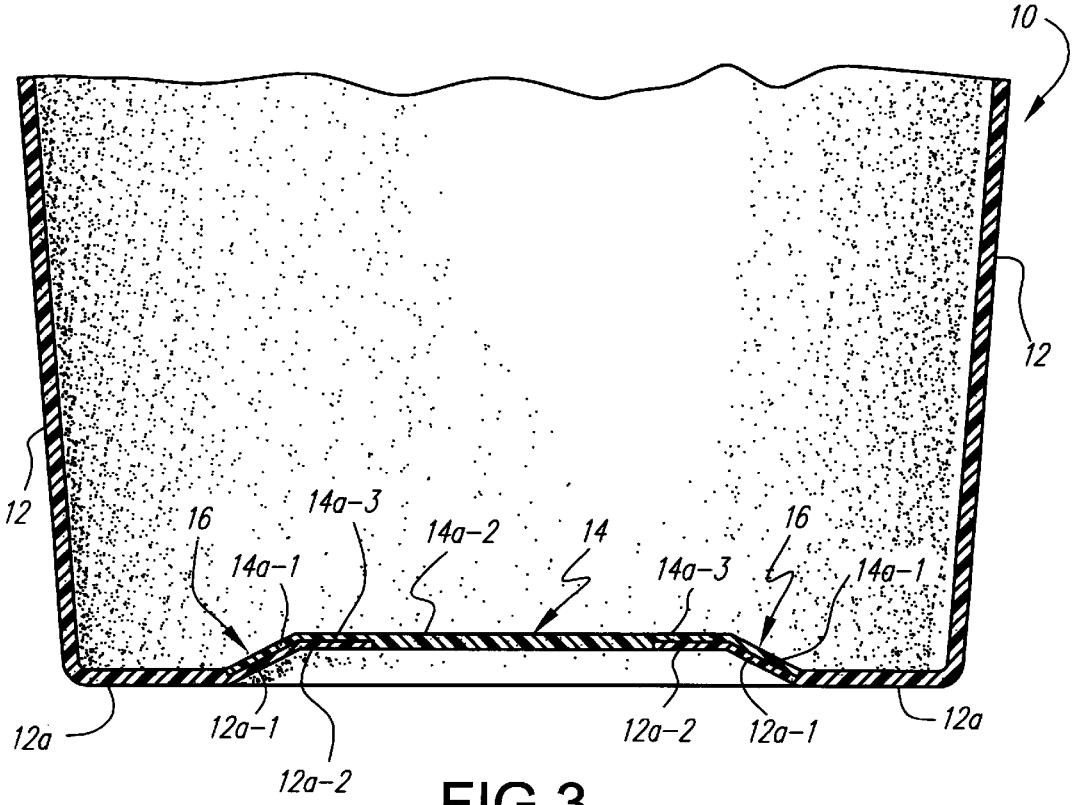
FIG. 3 is a cross-sectional elevational view of the bottom wall employed in the cup shown in FIG. 2.
Figure 2:
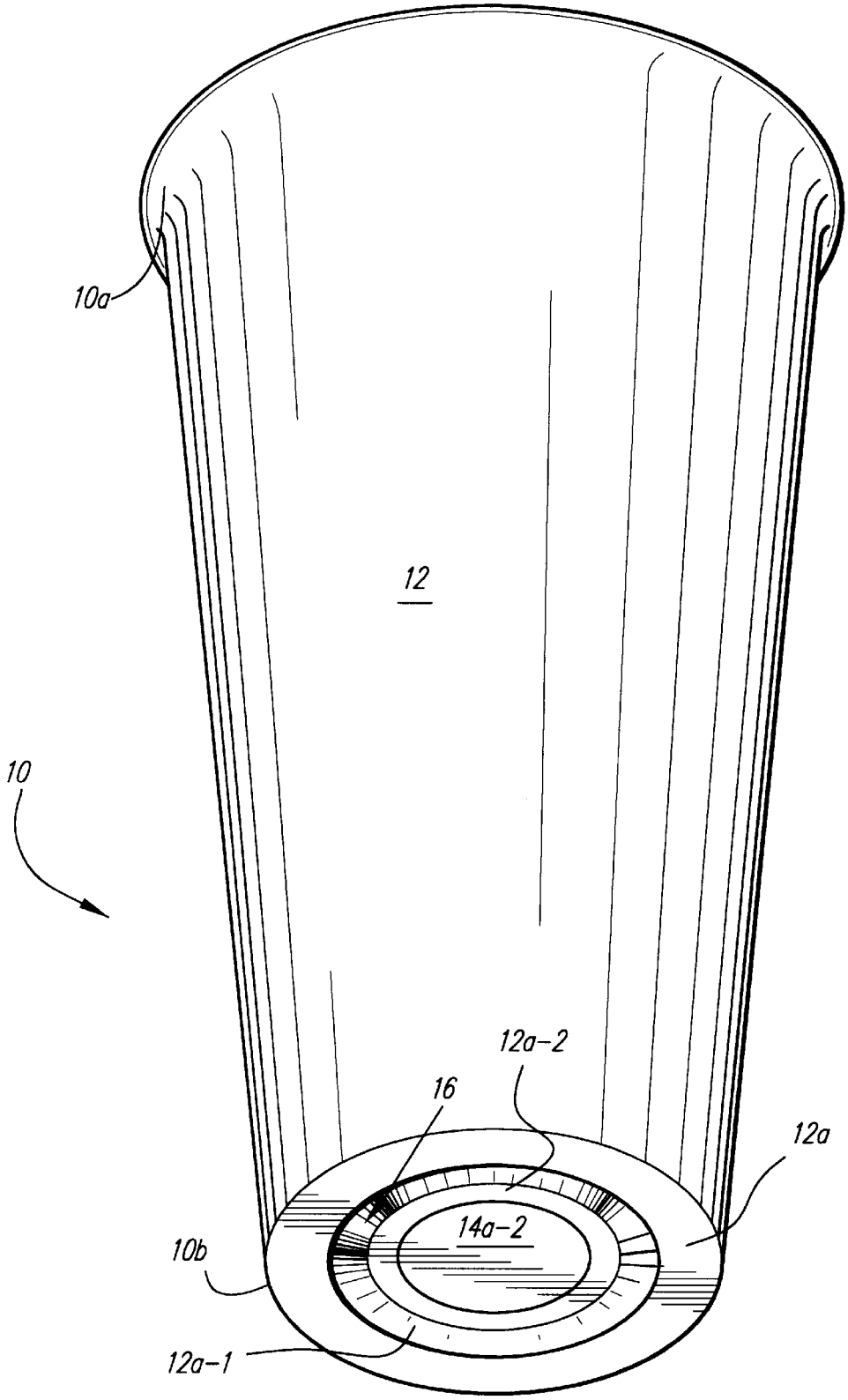
FIG. 2 is a perspective view of a two-piece thermoformed cup which embodies one form of a bottom wall according to the present invention.

Accompanying FIGS. 2 and 3 depict one embodiment of a cup 10 in accordance with the present invention. As can be seen therein, the cup 10 includes a side wall 12 which is formed of a single sheet of thermoformable plastics material whose ends are bonded to one another to form a longitudinally extending side seam (not shown) extending the entire length of the cup 10 from the annular lip portion 10*a* to its annular bottom edge portion 10*b*. The side wall 12 also terminates at its lowermost extent by an inwardly turned annular flange 12*a*. A bottom wall disc 14 is inserted into the bottom of the cup 10 so that it is in contact with the flange 12*a* of the side wall 12. During the formation process, the bottom wall disc 14 is bonded to the flange 12*a* through an annular upwardly and inwardly sloped transition wall 16.

As can be seen, the sloped transition wall 16 is comprised of superposed, compression welded peripheral annular sections 12*a*-1 and 14*a*-1 of the flange 12*a* and bottom wall 14, respectively. The pressure employed during the formation process is such that the material thickness of the superposed regions 12*a*-1 and 14*a*-1 is substantially equivalent to the material thickness of each one of the flange 12*a* and bottom wall disc 14. As such, the sloped transition wall 16 is formed of material that is significantly compressed as compared to the material forming either the side wall 12 or the bottom wall disc 14 thereby enhancing its structural integrity and rigidity. Thus, the sloped transition wall 16 is a lapped joint between the annular flange 12 of the side wall 12 and the bottom wall disc 14.

Most preferably, the lapped joint between the flange 12*a* and the bottom wall disc 14 extends from the flange 12*a*, along the sloped transition wall 16 and then radially inwardly along the recessed surface of the bottom wall 14. That is, as shown in FIG. 3, an annular terminal section 14*a*-3 of the central bottom wall 14*a*-2 and an annular terminal section 12*a*-2 are superposed and compression welded to one another.

The sloped transition wall 16 is most preferably planar in cross-section, but an arcuately configured cross-sectional geometry may also be provided. That is, the transition wall 16 is sloped upwardly and inwardly relative to the central region of the bottom wall disc 14. In such a manner, forming and sealing pressures at the juncture of the bottom wall disc

14 and the side wall 12 are avoided, thereby making the cup 10 in accordance with the present invention more resistant to failure at that juncture.

Figure 4:
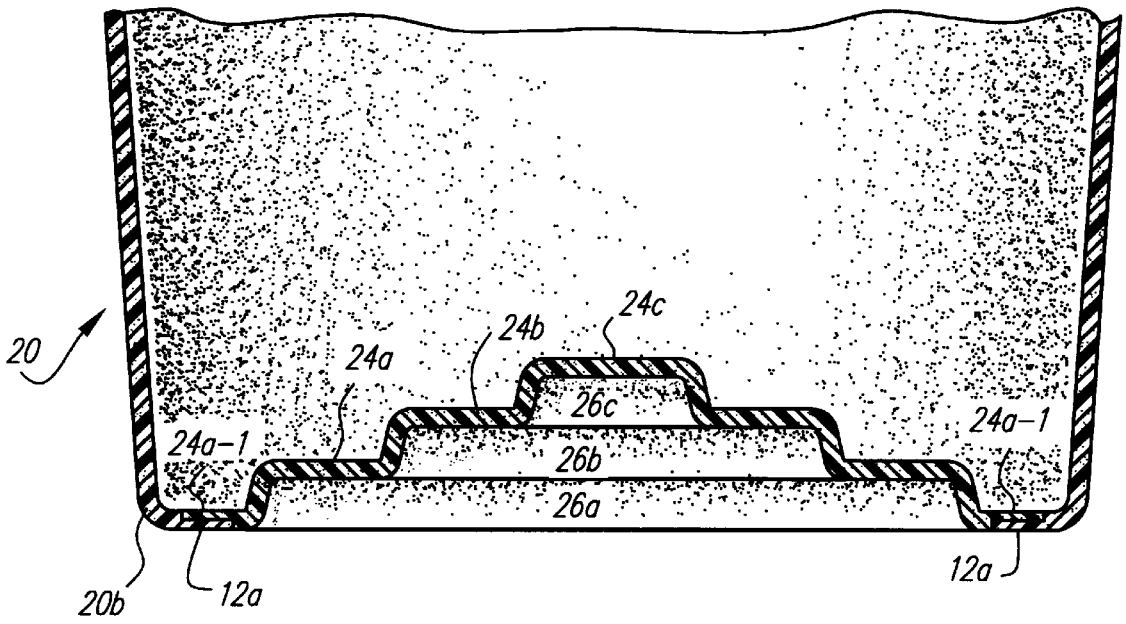
FIG. 4, is a cross-sectional elevational view of another embodiment of a bottom wall in accordance with the present inventions.

Another embodiment of a cup 20 in accordance with the present invention is depicted in accompanying FIG. 4. The cup 20 of the embodiment shown in FIG. 4, like the cup 10 described above, includes a sidewall 22 formed of a thermoformable plastics material whose opposed ends are overlapped and bonded to one another so as to establish a longitudinal side seam. The side wall 22 terminates in an inwardly turned annular bottom flange 22*a* which is bonded to the outer annular peripheral region 24*a*-1 of the bottom wall disc 24 so as to form a fluid-tight seal therebetween.

The bottom wall disc 24 is provided with a series of horizontally disposed annular bottom wall segments 24*a*, 24*b* and a series of upwardly and inwardly sloped transition walls 26*a*, 26*b*, respectively. The transition wall 26*a* terminates in the peripheral region 24*a*-1 which is joined to the bottom flange 12*a* of the sidewall 12. The transition wall 26*b*, on the other hand, joins the bottom wall segments 24*a* and 24*b*. A further bottom wall segment 24*c* in the form of a horizontally disposed disc is joined to the next lowermost bottom wall segment 24*b* via an upwardly and inwardly sloped transition wall 26*c*.

The annular bottom wall segments 24*a*–24*c* are most preferably concentrically disposed relative to one another, with the inner ones of the segments being of a lesser radial dimension as compared to immediately adjacent outer ones of the segments. As such, the bottom wall segments 24*a*–24*b*, the central bottom wall disc 24*c*, and the annular transition walls 26*a*–26*c* collectively define a terraced recessed bottom to the cup 20 which serves to increase the structural integrity of the cup along the bottom edge 20*b*.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cup comprising:

a sidewall formed of a sheet of a thermoformable plastics material having opposed ends bonded to one another to establish a side seam extending longitudinally from an upper rim of the sidewall to a bottom edge thereof;

said sidewall terminating in an inwardly directed annular bottom flange; and a bottom wall disc bonded to said bottom flange of said sidewall, said bottom wall disc including a central bottom wall section, and a least one upwardly and inwardly sloped transition wall joining said central bottom wall section and said bottom flange; wherein said transition wall is formed by superposed segments of said bottom wall disc and said bottom flange, said superposed segments being compression bonded to one another at a compression bonding region so that the material thickness of said transition wall at said compression bonding region is substantially equivalent to material thicknesses of each one of said bottom wall flange and said bottom wall disc.

2. A cup as in claim 1, wherein said transition wall has a planar cross-section.

3. A cup as in claim 1, wherein said bottom wall disc includes a central bottom wall portion bounded by said transition wall, and wherein said transition wall includes an annular terminal section which is compression bonded to said central bottom wall section.

4. The cup as in claim 1, wherein said central bottom wall section is substantially horizontal, and wherein said bottom wall disc includes at least one annular, substantially horizontal bottom wall segment, and a second upwardly and inwardly sloped transition wall joining said at least one bottom wall segment and said central bottom wall section.

5. The cup as in claim 4, wherein said bottom wall disc includes a plurality of said annular substantially horizontal bottom wall segments connected to one another by respective upwardly and inwardly sloped transition walls.

6. The cup as in any one of the preceding claims, wherein said sidewall and bottom wall disc are formed of expanded polystyrene.

7. A cup comprising:

a sidewall formed of a sheet of a thermoformable plastics material having opposed ends bonded to one another to establish a side seam extending longitudinally from an upper rim of the sidewall to a bottom edge thereof;

said sidewall terminating in an inwardly directed annular bottom flange; and a bottom wall bonded to said bottom flange of said sidewall, said bottom wall including a substantially horizontal central bottom wall section, at least one annular, substantially horizontal bottom wall segment, and upwardly and inwardly sloped transition walls respectively joining said at least one annular bottom wall segment to each of said central bottom wall section and said bottom flange; wherein said transition walls are formed by respective superposed segments of said at least one annular bottom wall segment with each of said central bottom wall section and said bottom flange, said superposed segments being compression bonded to one another at respective compression bonding regions so that material thicknesses of said transition walls at said compression bonding regions are substantially equivalent to material thicknesses of each one of said central bottom wall section, said bottom flange and said at least one annular bottom wall segment.

8. The cup as in claim 7, wherein said bottom wall disc includes a plurality of said annular substantially horizontal bottom wall segments connected to one another by respective upwardly and inwardly sloped transition walls.

9. The cup as in claim 8, wherein said annular bottom wall segments are concentrically disposed.

10. The cup as in any one of claims 7–9, wherein said sidewall and bottom wall disc are formed of expanded polystyrene.

* * * * *